US008091353B2

(12) United States Patent
Nakahira et al.

(10) Patent No.: US 8,091,353 B2
(45) Date of Patent: Jan. 10, 2012

(54) EXHAUST DEVICE FOR A DIESEL ENGINE

(75) Inventors: Toshio Nakahira, Sakai (JP); Masahiko Sugimoto, Sakai (JP); Shuichi Yamada, Sakai (JP); Katsushi Inoue, Sakai (JP); Hirozumi Kuwabara, Sakai (JP)

(73) Assignee: Kubota Corporation, Osaka (JP)

( * ) Notice: Subject to any disclaimer, the term of this patent is extended or adjusted under 35 U.S.C. 154(b) by 971 days.

(21) Appl. No.: 12/048,759

(22) Filed: Mar. 14, 2008

(65) Prior Publication Data

US 2009/0044522 A1 Feb. 19, 2009

(30) Foreign Application Priority Data

Aug. 15, 2007 (JP) ..... 2007-211781
Aug. 29, 2007 (JP) ..... 2007-222730

(51) Int. Cl.
*F01N 3/00* (2006.01)
*F01N 3/10* (2006.01)
*B01D 46/00* (2006.01)

(52) U.S. Cl. ..... 60/303; 60/286; 60/295; 95/278; 95/283

(58) Field of Classification Search ..... 60/286, 60/295, 300, 303; 95/278, 279, 283, 285; 422/173, 174, 177, 182, 183
See application file for complete search history.

(56) References Cited

U.S. PATENT DOCUMENTS 5,826,428 A * 10/1998 Blaschke ..... 60/303
2004/0187483 A1* 9/2004 Dalla Betta et al. ..... 60/286
2006/0096282 A1* 5/2006 Friedrich et al. ..... 60/299

FOREIGN PATENT DOCUMENTS

EP 1479883 A1 11/2004
JP 2005-256769 A 9/2005
JP 2007-239734 A 9/2007
JP 2008-19796 A 1/2008
WO 2007/011113 A1 1/2007
WO 2007/037652 A1 4/2007

OTHER PUBLICATIONS

Nakahira et al., Machine Translation of JP 2005-256769 A, Sep. 22, 2005.*

* cited by examiner

*Primary Examiner* — Thomas Denion
*Assistant Examiner* — Audrey K Bradley
(74) *Attorney, Agent, or Firm* — Panitch Schwarze Belisario & Nadel LLP

(57) ABSTRACT

The present invention has an object to provide an exhaust device for a diesel engine capable of surely burning flammable gas in an exhaust route.

In the exhaust device for the diesel engine, liquid fuel (6) is supplied from a liquid-fuel supply source (5) to a gas generator (3). The gas generator (3) converts the liquid fuel (6) to flammable gas (7) and has a flammable-gas flow outlet (9) of the with which an exhaust route (1) is communicated upstream of a diesel-particulate-filter (2). The flammable gas (7) flowed out from the flammable-gas flow outlet (9) is burnt with oxygen in exhaust gas (10) to produce combustion heat. The exhaust gas (10) heated by the thus produced combustion heat can burn the exhaust-gas fine particles remaining at the filter (2). The gas generator (3) is provided with a catalyst chamber (51) which houses a catalyst (4). Catalyst-combustion heat is generated in the catalyst chamber (51) which is arranged along an external periphery of a peripheral wall (1*a*) of the exhaust route (1).

18 Claims, 5 Drawing Sheets

EXHAUST DEVICE FOR A DIESEL ENGINE

BACKGROUND OF THE INVENTION

The present invention relates to an exhaust device for a diesel engine and more particularly, concerns an exhaust device for a diesel engine able to surely burn flammable gas present in an exhaust route.

There is an example of the conventional exhaust devices for the diesel engine that supplies liquid fuel from a supply source of liquid fuel to a gas generator, which converts the liquid fuel to flammable gas as well as the present invention. This gas generator has a flammable-gas flow outlet which is communicated with an exhaust route upstream of a diesel-particulate-filter and from which flammable gas is flowed out and burnt with oxygen in exhaust gas to produce combustion heat. The exhaust gas heated with the thus produced combustion heat can burn the exhaust-gas fine particles remaining at the filter.

It is known that the exhaust device of this type has an advantage of being able to increase the temperature of the exhaust gas flowing into the filter with the combustion heat of the flammable gas in the exhaust route, to burn the exhaust-gas fine particles, and to recover the filter, even in light-load operation with the exhaust gas of a low temperature.

However, the above-mentioned conventional exhaust device has no means for inhibiting the radiation of the heat within the exhaust route from the peripheral wall thereof with the result of causing problems.

DISCLOSURE OF THE INVENTION

Problem the Invention Attempts to Solve

The conventional art has the following problem.

<Problem> There is a case where the flammable gas does not burn in the exhaust route.

It has no means for inhibiting the radiation of the heat within the exhaust route from the peripheral wall thereof and therefore the temperature of the flammable gas is lowered with the result of being probably unable to burn the flammable gas in the exhaust route.

SUMMARY OF THE INVENTION

The present invention has an object to provide an exhaust device for a diesel engine capable of solving the above-mentioned problem and more specifically, an exhaust device for a diesel engine able to surely burn the flammable gas in the exhaust route.

Means for Solving the Problem

The invention as defined in claim 1 has the following featuring matter.

As exemplified in FIGS. 1, 2 and 5, a liquid-fuel supply source 5 supplies liquid fuel 6 to a gas generator 3, which converts the liquid fuel 6 to flammable gas 7. The gas generator 3 has a flammable-gas flow outlet 9 which is communicated with an exhaust route 1 upstream of a diesel-particulate-filter 2 and from which the flammable gas 7 is flowed out and burnt with oxygen in exhaust gas 10 to produce combustion heat. The exhaust gas 10 heated with the combustion heat can burn the exhaust-gas fine particles remaining at the filter 2. An exhaust device for a diesel engine thus arranged is characterized in that:

as exemplified in FIGS. 2, 3 and 6, the gas generator 3 is provided with a catalyst chamber 51 which contains a catalyst 4 and in which catalyst-combustion heat is produced, the catalyst chamber 51 being arranged along an external periphery of a peripheral wall la of the exhaust route 1.

EFFECT OF THE INVENTION (Invention of Claim 1)

<Effect> It is possible to burn the flammable gas in the exhaust route reliably.

As exemplified in FIGS. 2, 3 and 5, the gas generator 3 is provided with a catalyst chamber 51 which contains a catalyst 4 and in which catalyst-combustion heat is produced. The catalyst chamber 51 is arranged along an external periphery of a peripheral wall 1*a* of the exhaust route 1. Therefore, the catalyst chamber 51 avoids the problem that the heat in the exhaust route 1 is radiated from the peripheral wall 1*a* of the exhaust route 1 to result in retaining the flammable gas 7 at a high temperature. This assures the combustion of the flammable gas 7 in the exhaust route 1.

<Effect> The exhaust device can be made compact.

As illustrated in FIGS. 2, 3 and 6, since the catalyst chamber 51 is disposed along the external periphery of the peripheral wall 1*a* of the exhaust route 1, the exhaust device can be made compact.

<Effect> It is possible to omit or shorten the piping from the flammable-gas flow outlet to the exhaust route.

As shown in FIGS. 2, 3 and 6, the catalyst chamber 51 is disposed along the external periphery of the peripheral wall 1*a* of the exhaust route 1. In consequence, it is possible to omit or shorter the piping from the flammable-gas flow outlet 9 to the exhaust route 1.

(Invention of Claim 2)

It offers the following effect in addition to that of the invention as set forth in claim 1.

<Effect> It has a high function of burning the flammable gas in the xhaust route.

As exemplified in FIGS. 2, 3 and 6, the catalyst chamber 51 is arranged along the whole region in a peripheral direction of the peripheral wall 1*a*. Therefore, it has a high function of inhibiting the heat radiation from the exhaust-route peripheral wall 1*a*, which in turn results in a high function of burning the flammable gas 7 in the exhaust route 1.

<Effect> It is possible to make the exhaust device more compact.

As shown in FIGS. 2, 3 and 6, the catalyst chamber 51 is arranged along the whole periphery of the exhaust-route peripheral wall 1*a*, so that the exhaust device can be made more compact.

(Invention of Claim 3)

It offers the following effect in addition to that presented by the invention as defined in claim 1 or 2.

<Effect> With the exhaust gas having a low temperature, it is possible to more assuredly burn the flammable gas in the exhaust route.

As exemplified in FIGS. 2 and 6, the flammable gas 7 heated in the catalyst chamber 51 is mixed with part 10*a* of the exhaust gas 10 in a flammable-gas mixing passage 15, and an ignition means 45 can ignite the flammable gas 7. In consequence, even if the exhaust gas 10 has a low temperature, the flammable gas 7 has its temperature hardly lowered when compared with a case of mixing the whole amount of the exhaust gas 10 with the flammable gas 7 and therefore can be surely ignited by the ignition means 45. This can more assuredly burn the flammable gas 7 in the exhaust route 1.

(Invention of Claim 4)

It offers the following effect in addition to that of the invention as defined in claim 3.

<Effect> It is possible to perform the combustion of the flammable gas without failure.

As exemplified in FIGS. 2 and 5, the flammable-gas mixing passage 15 has a sectional area varying along a flow direction. This changes the flow speed of mixed gas 67 which consists of the flammable gas 7 and part 10*a* of the exhaust gas 10, within the flammable-gas mixing passage 15 to generate a portion where the flame propagation speed of the mixed gas 67 becomes lower than its passing speed. Due to this fact, the combustion flame produced within the flammable-gas mixing passage 15 hardly disappears with the result of being able to surely burn the flammable gas 7.

(Invention of Claim 5)

It offers the following effect in addition to that presented by the invention as defined in claim 4.

<Effect> It is possible to assuredly perform the combustion of the flammable gas 7.

As illustrated in FIGS. 2 and 5, the flammable-gas mixing passage 15 has a sectional area increasing toward the downstream. Thus the mixed gas 67 passes at a lower speed as it flows toward the downstream, thereby assuredly retaining the combustion flame produced upstream of the flammable-gas mixing passage 15. This makes it possible to burn the flammable gas 7 surely.

(Invention of Claim 6)

It offers the following effect in addition to that presented by the invention as defined in any one of claims 3 to 5.

<Effect> A connection portion between an outlet-side flange and an inlet-side flange has a high sealing ability.

As exemplified in FIG. 2 or FIG. 5, a cylindrical wall 1*d* is provided inside the exhaust route 1. A heat-insulation space 1*e* is defined between the cylindrical wall 1*d* and the peripheral wall 1*a* of the exhaust route 1 and between the cylindrical wall 1*d* and the outlet-side flange 1*c*. In consequence, the cylindrical wall 1*d* and the heat-insulation spaces 1*e* shield the heat of the exhaust gas 10 and the flammable gas 7. This inhibits the outlet-side flange 1*c* and the inlet-side flange 11*c* from being overheated by the above-mentioned heat to result in a high sealing ability at the connection portion between the outlet-side flange 1*c* and the inlet-side flange 11*c*.

(Invention of Claim 7)

It offers the following effect in addition to that presented by the invention as defined in any one of claims 3 to 6.

<Effect> Mis-ignition of the flammable gas hardly occurs in the exhaust route.

As exemplified in FIG. 2, an ignition means 45 is an igniting electric heater 45*a*. Therefore, it does not cause such an incident that carbon adheres to the electrode with the result of failing to throw sparks and ignite the flammable gas 7 like a spark plug. Thus mis-ignition of the flammable gas 7 hardly occurs in the exhaust route 1.

(Invention of Claim 8)

It offers the following effect in addition to that presented by the invention as defined in any one of claims 3 to 6.

<Effect> The flammable gas in the exhaust route can be burnt without failure.

As illustrated in FIG. 5, the exhaust-route peripheral wall 1*a* with the catalyst chamber 51 arranged along the same serves as a heat-radiation wall 8 which is used as the ignition means 45. This can burn the flammable gas 7 in the exhaust route 1 assuredly.

(Invention of Claim 9)

It offers the following effect in addition to that presented by the invention as defined in any one of claims 3 to 8.

<Effect> It has a high function of assuredly burning the flammable gas in the exhaust route.

As exemplified in FIG. 1, since an oxidation catalyst 12 is arranged downstream of the ignition means 45 and upstream of the filter 2, the flammable gas 7 which did not begin burning by the ignition of the ignition means 45 can be burned by the oxidation catalyst 12. This offers a high function of surely burning the flammable gas 7 in the exhaust route 1.

(Invention of Claim 10)

It offers the following effect in addition to that presented by the invention as defined in any one of claims 1 to 9.

<Effect> The efficiency of gas generation is enhanced in the catalyst chamber.

As illustrated in FIG. 4(B), the catalyst-combustion heat produced in the catalyst chamber 51 can be conveyed through a heat conductor 58 to a fuel nozzle 53. This accelerates the vaporization of the liquid fuel 6 so as to supply uniform mixed air 56 to the catalyst chamber 51 with the result of increasing the efficiency of the gas generation.

<Effect> It is possible to make use of the catalyst-combustion heat for forming uniform mixed air.

As illustrated in FIG. 4(B), the catalyst-combustion heat produced in the catalyst chamber 51 can be conveyed through the heat conductor 58 to the fuel nozzle 53. While the catalyst-combustion heat is being generated, the catalyst-combustion heat can be utilized for forming uniform mixed gas 56.

(Invention of Claim 11)

It offers the following effect in addition to that presented by the invention as defined in claim 10.

<Effect> There is a high function of enhancing the efficiency of the gas generation in the catalyst chamber.

As exemplified in FIG. 4(B), the heat conductor 58 has an exposed surface 58*a* disposed at a position opposite to an inlet 51*a* of the catalyst chamber 51 and the liquid fuel 6 flowed from an outlet 57 of a mixing chamber 55 is brought into contact with the exposed surface 58*a* of the heat conductor 58. Accordingly, the liquid fuel 6 still remaining unvaporised in the mixing chamber 55 can be vaporized with the exposed surface 58*a* of the heat conductor 58. This accelerates the vaporization of the liquid fuel 6 and supplies uniform mixed gas 56 to the catalyst chamber 51, which results in a high function of enhancing the efficiency of the gas generation in the catalyst chamber 51.

(Invention of Claim 12)

It offers the following effect in addition to that presented by the invention as defined in claim 11.

<Effect> It is possible to promptly effect the commencement of the gas generation in the catalyst chamber.

As shown in FIG. 4(B), an electric heater 65 is brought into contact with the heat conductor 58 so as to heat the heat conductor 58 upon commencing the generation of the flammable gas 7. Therefore, upon the commencement of the generation of the flammable gas during which the catalyst-combustion heat is not produced, the electric heater 65 can heat the heat conductor 58. This makes it possible to promptly commence the gas generation in the catalyst chamber 51.

(Invention of Claim 13)

It offers the following effect in addition to that of the invention as defined in any one of claims 1 to 12.

<Effect> The exhaust device can be made compact.

As exemplified in FIG. 4(B), substrates 4*a* of the catalyst 4 form the mixed gas passage in the shape of cubic mesh. This can reduce the volume of the catalyst chamber 51 so as to make the exhaust device compact.

(Invention of Claim 14)

It offers the following effect in addition to that of the invention as defined in claim 13.

<Effect> It is possible to easily form the mixed gas passage of cubic-mesh shape.

As illustrated in FIG. 4(C), pellet-like substrates are employed for the substrates 4*a* and a gap between adjacent substrates 4*a*, 4*a* defines the mixed gas passage of cubic-mesh shape. Therefore, it suffices if the catalyst 4 is filled in the catalyst chamber 51, in order to form the mixed gas passage of cubic-mesh shape.

<Effect> The catalyst is easily charged in the catalyst chamber.

As exemplified in FIG. 4(C), the pellet-like substrate is used for the substrate 4 to entail an easy charging of the catalyst into the catalyst chamber 51.

(Invention of Claim 15)

It offers the following effect in addition to that presented by the invention as defined in claim 13.

<Effect> The substrate has a high property of heat-resistance.

As exemplified in FIG. 4(C), since a pellet-like ceramic is used for the substrate 4*a*, the substrate 4*a* is highly resistant to heat.

<Effect> It is possible to prevent the breakage of the substrate caused by vibration.

As shown in FIG. 4(C), the substrates 4*a* are mixed with metal springs 66 and the thus resulting mixture is housed in the catalyst chamber 51 so as for the metal springs 66 to serve as cushions for the substrates 4*a*. In consequence, the substrates 4*a* can be prevented from breaking by the vibration.

(Invention of Claim 16)

It offers the following effect in addition to that presented by the invention as defined in any one of claims 1 to 15.

<Effect> The exhaust device can be produced at a low cost.

As illustrated in FIG. 1, fuel from a fuel reservoir 5*a* of the diesel engine is used for the liquid fuel 6. When mixing the liquid fuel 6 with air 44, air from a supercharger 39 is utilized as the air 44. Thus the fuel reservoir 5*a* and the supercharger 39 of the diesel engine with the supercharger serve as the fuel supply source and the air supply source of the gas generator 3 to entail an advantage of being able to produce the exhaust device at a low cost.

(Invention of Claim 17)

It offers the following effect in addition to that presented by the invention as defined in any one of claims 1 to 16.

<Effect> The combustion heat of the flammable gas is stably obtained.

The liquid fuel 6 is vaporized in the catalyst chamber 51 so as to convert the liquid fuel 6 into the flammable gas 7. So when compared with the partial oxidation or the like reaction, there is a little variation of the component ratio of the flammable gas 7 and therefore the combustion heat of the flammable gas 7 is stably obtained.

(Invention of Claim 18)

It offers the following effect in addition to that presented by the invention as defined in any one of claims 1 to 16.

<Effect> Even with the exhaust gas of low temperature, the flammable gas can be burnt.

The liquid fuel 6 is partially oxidized in the catalyst chamber 51 to reform the liquid fuel 6 into the flammable gas 7 containing carbon monoxide and hydrogen. In consequence, the flammable gas 7 is ignited even at a relatively low temperature. Further, even if the exhaust gas 10 has a low temperature, the flammable gas 7 can be burnt.

BRIEF DESCRIPTION OF THE DRAWINGS

[FIG. 4] FIG. 4(C) is an explanatory view of a variant of an oxidation catalyst; and.

MOST PREFERRED EMBODIMENT OF THE INVENTION

An explanation is given for an embodiment of the present invention with reference to the drawings. FIGS. 1 to 4 show an exhaust device for a diesel engine in accordance with a first embodiment of the present invention. FIG. 5 shows an exhaust device for a diesel engine in accordance with a second embodiment.

The first embodiment of the present invention is outlined as follows.

Figure 1:
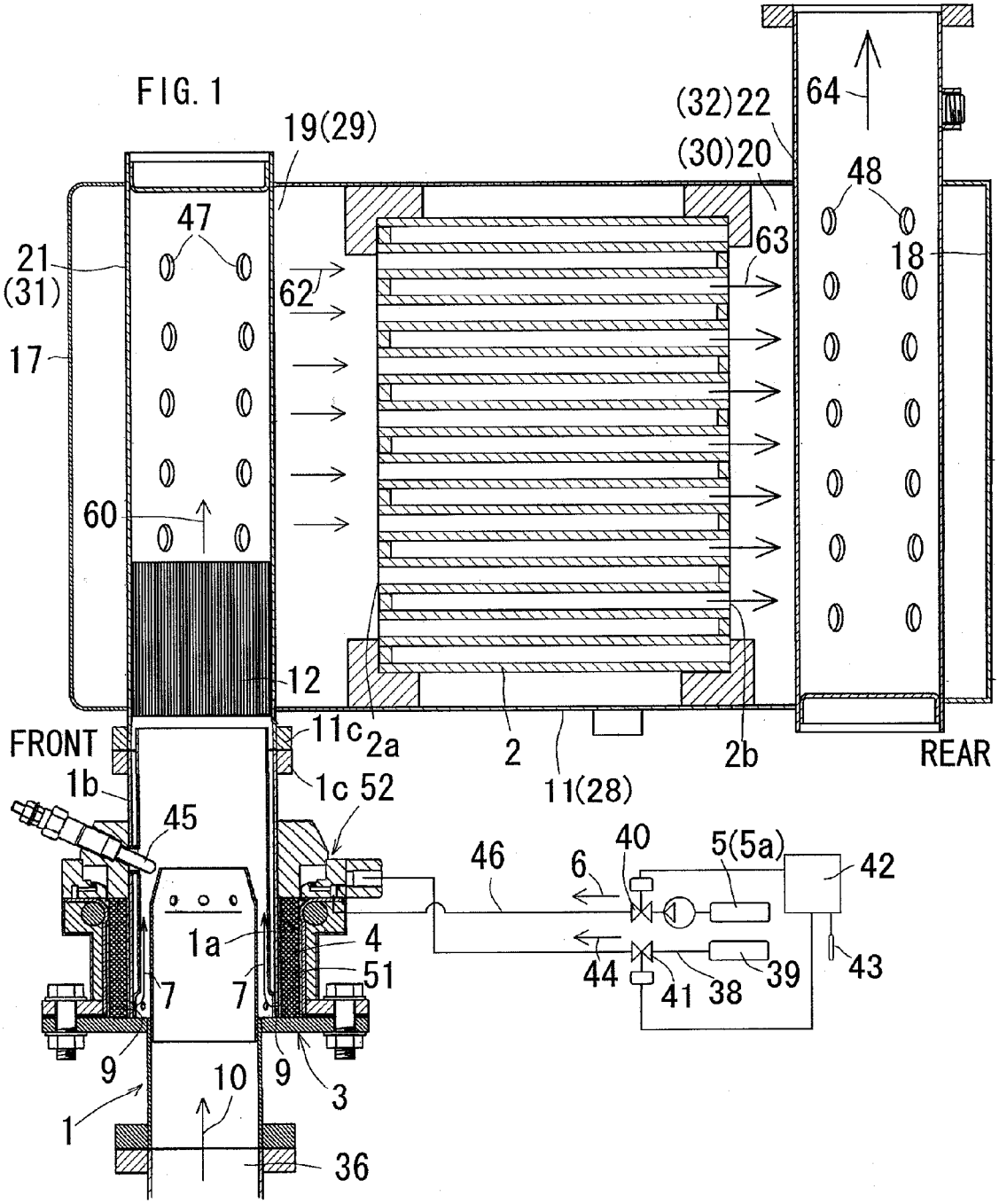
[FIG. 1] shows an exhaust device, in vertical section, for a diesel engine in accordance with a first embodiment of the present invention.

As shown in FIG. 1, liquid fuel 6 is supplied from a liquid-fuel supply source 5 to a gas generator 3, which converts the liquid fuel 6 to flammable gas 7. The gas generator 3 has a flammable-gas flow outlet 9 which is communicated with an exhaust route 1 upstream of a diesel-particulate-filter 2. The flammable gas 7 flowed out from the flammable-gas flow outlet 9 is burnt with oxygen in exhaust gas 10 to produce combustion heat. The thus produced combustion heat heats the exhaust gas 10 and the exhaust gas 10 heated as such can burn exhaust-gas fine particles remaining at the filter 2. This exhaust device is connected to an outlet 36 of an exhaust manifold of the diesel engine. The diesel-particulate-filter 2 is generally called as "DPF" and is formed into a honeycomb structure made of ceramic. Further, the diesel-particulate-filter 2 supports an oxidation catalyst or may support Nox-occlusion catalyst.

The gas generator is devised as follows.

Figure 2:
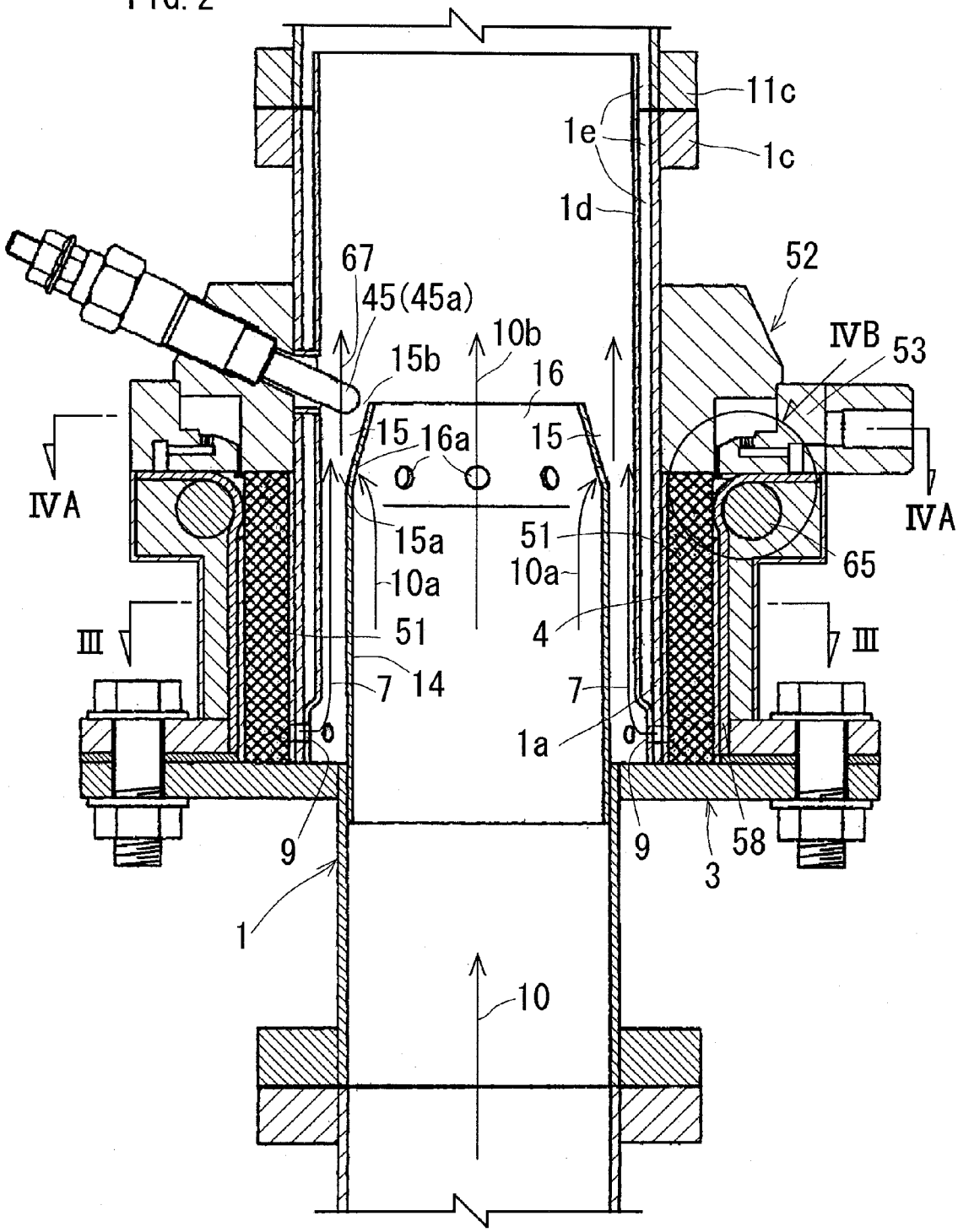
[FIG. 2] shows a gas generator and its surroundings, in vertical section, of the exhaust device shown in FIG. 1.
Figure 3:
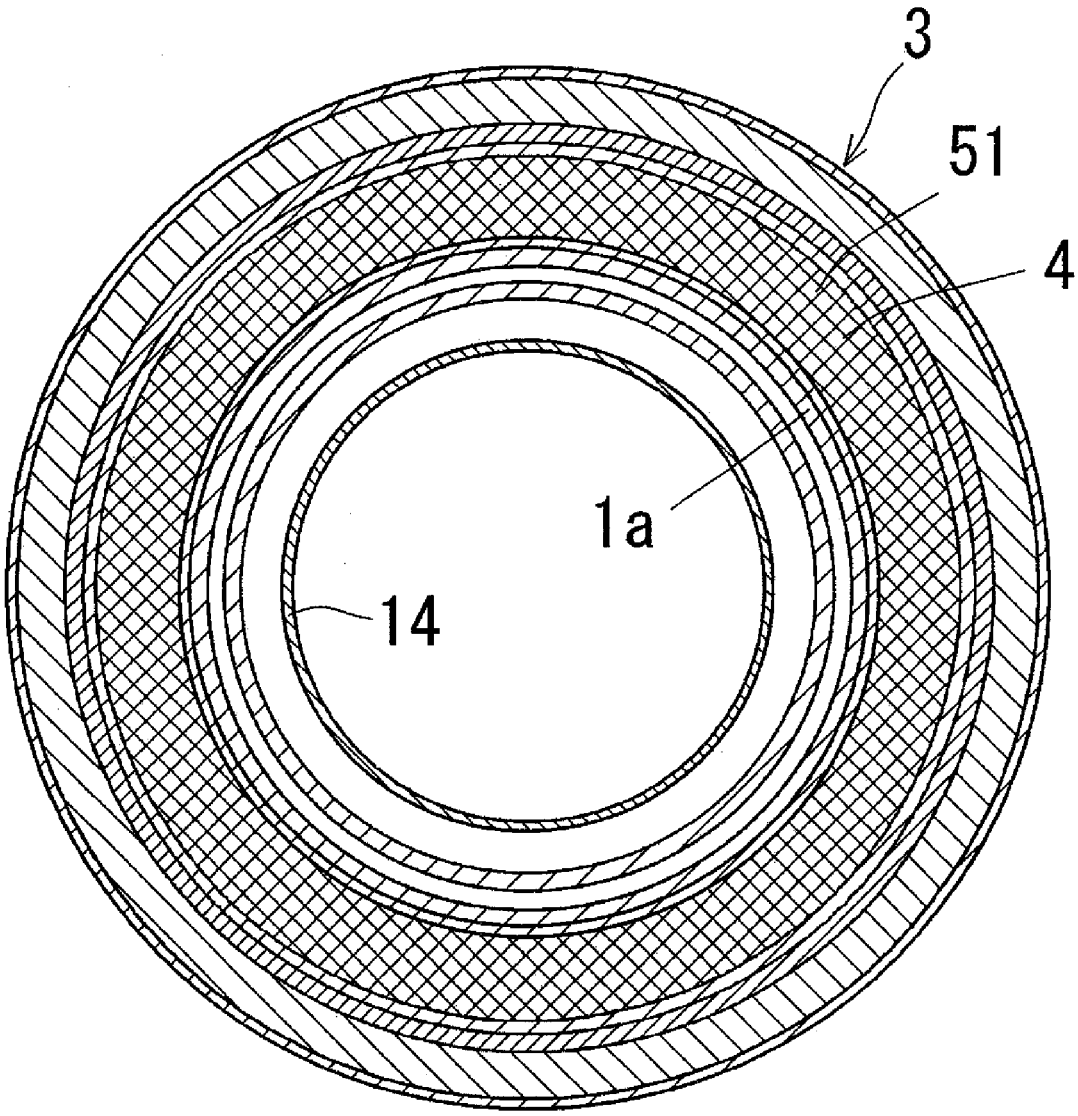
[FIG. 3] is a sectional view taken along a line III-III in FIG. 2.
Figure 4A:
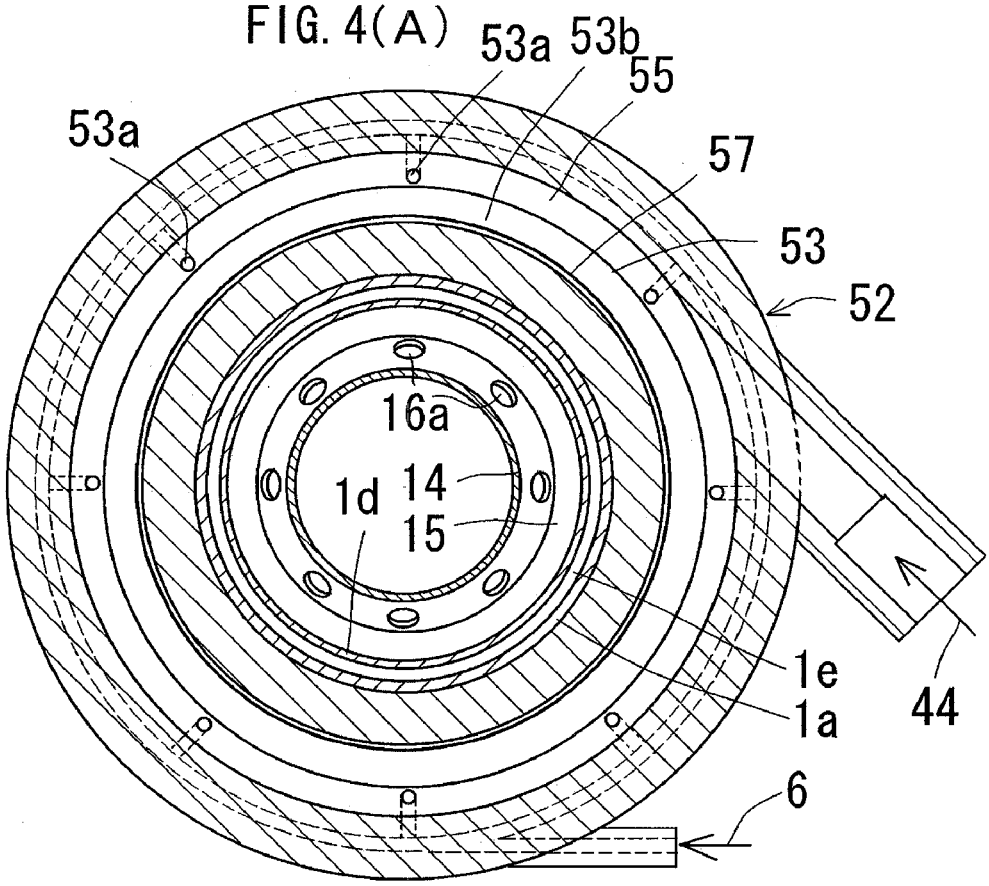
FIG. 4(A) is a sectional view taken along a line IVA-IVA in FIG. 2.

As shown in FIGS. 2 and 3, the gas generator 3 is provided with a catalyst chamber 51, which houses a catalyst 4 and in which the catalyst-combustion heat is produced. The catalyst chamber 51 is arranged along an external periphery of a peripheral wall 1*a* of the exhaust route 1.

Additionally, this catalyst chamber 51 is disposed over an entire area in a peripheral direction of the peripheral wall 1*a* of the exhaust route 1.

As shown in FIG. 2, there is provided a partition wall 14 within the exhaust-route peripheral wall 1*a* with the catalyst chamber 51 arranged along the same. This partition wall 14 divides an interior area of the exhaust route 1 into a flammable-gas mixing passage 15 and an exhaust-gas passage 16. The flammable-gas mixing passage 15 has a starting end portion 15*a* with which the flammable-gas flow outlet 9 is communicated and has an terminal end portion 15*b* at which an ignition means 45 is arranged.

Owing to the above arrangement, the flammable gas 7 heated within the catalyst chamber 51 is mixed with part 10*a* of the exhaust gas 10 in the flammable-gas mixing passage 15, and the ignition means 45 can ignite the flammable gas 7. The ignition means 45 may be disposed at a predetermined portion in a region extending from an interior area of the flammable-gas mixing passage 15 to just after its terminal end portion 15*b*. The ignition means 45 is an igniting electric heater 45*a* and concretely uses a sheath type glow plug. The sheath type glow plug comprises a heat-resistant tube housing a heating coil.

The partition wall 14 is in the shape of a circular cylinder and has a leading end portion formed in the shape of a truncated-cone. This leading end portion partitions an interior area of the exhaust route 1 into the external flammable-gas mixing passage 15 and the internal exhaust-gas passage 16. At the staring end portion 15*a* of the flammable-gas mixing passage 15, the partition wall 14 is provided with a plurality of exhaust-gas diverging ports 16*a* via which part 10*a* of the exhaust gas 10 passes through the exhaust-gas passage 16, and the part 10*a* of the exhaust gas 10 diverges into the flammable-gas mixing passage 15. Besides, as shown in FIGS. 2 and 4(A), the cylindrical wall 1*b* is in the shape of a circular cylinder. More specifically, the flammable-gas mixing passage 15 has a sectional area varying along a flow direction and increasing gradually toward the downstream.

As shown in FIG. 1, an oxidation catalyst 12 is arranged downstream of the ignition means 45 and upstream of the filter 2.

As shown in FIG. 2, an outlet-side flange 1*c* is provided at an end portion downstream of the exhaust-route peripheral wall 1*a* and an inlet-side flange 11*c* is positioned at a case 11 for housing the filter 2. When connecting the outlet-side flange 1*c* of the exhaust-route peripheral wall 1*a* to the inlet-side flange 11*c* of the filter-housing case 11, the cylindrical wall 1*d* is provided inside the exhaust route 1 and a heat-insulation space 1*e* is defined between the cylindrical wall 1*d* and the exhaust-route peripheral wall 1*a* as well as between the cylindrical wall 1*d* and the outlet-side flange 1*c*.

A mixer is devised as follows.

Figure 4B:
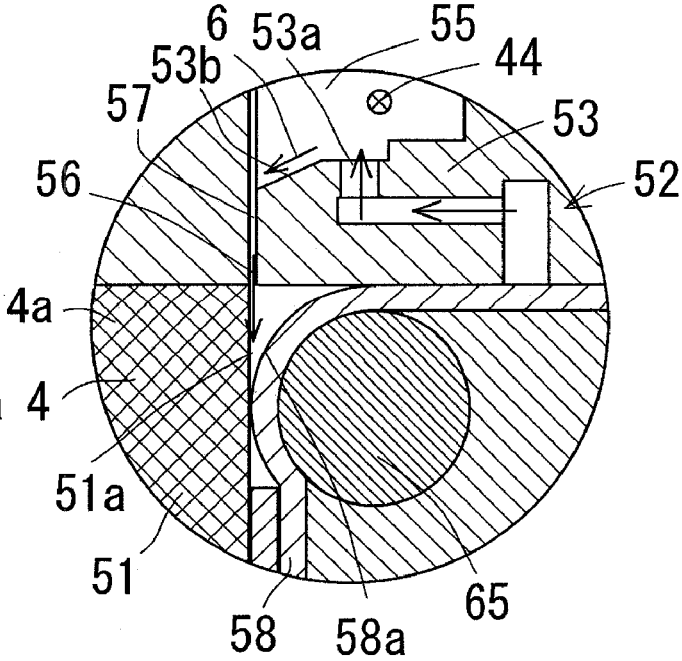
FIG. 4(B) is an enlarged view when seen in a direction indicated by an arrow IVB in FIG. 2.
Figure 5:
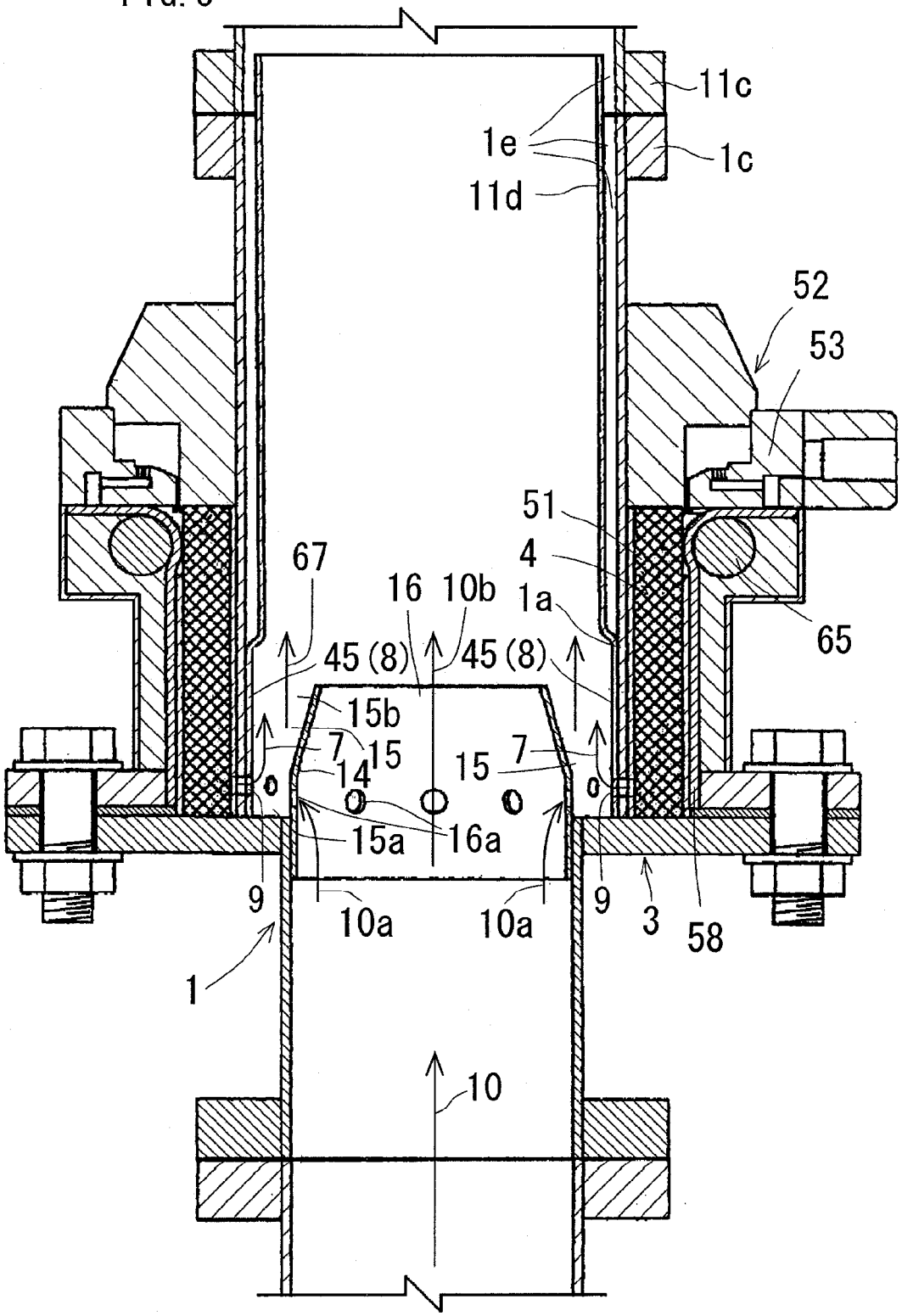
[FIG. 5] is a view showing an exhaust device for a diesel engine in accordance with a second embodiment of the present invention and corresponding to FIG. 2.

As shown in FIG. 2, a mixer 52 is arranged above the catalyst chamber 51, namely on a side of an inlet 51*a* of the catalyst chamber 51 and as shown in FIG. 4(B), the liquid fuel 6 supplied from a fuel nozzle 53 is mixed with air 44 in a mixing chamber 55 to provide mixed air 56. When this mixed air 56 is fed from an outlet 57 of the mixing chamber 55 to the inlet 51*a* of the catalyst chamber 51, the catalyst-combustion heat produced in the catalyst chamber 51 can be conveyed to the fuel nozzle 53 through a heat conductor 58.

The heat conductor 58 has an exposed surface 58*a* arranged at a position opposite to the inlet 51*a* of the catalyst chamber 51 below the outlet 57 of the mixing chamber 55. This allows the liquid fuel 6 that has dropped (i.e. flowed) from the outlet 57 of the mixing chamber 55 to contact with the exposed surface 58*a* of the heat conductor 58.

An electric heater 65 is brought into contact with the heat conductor 58 so as to heat the heat conductor 58 upon commencing the generation of the flammable gas.

As shown in FIG. 4(A), the mixing chamber 55 is annularly formed and the fuel nozzle 53 has a plurality of fuel injection ports 53*a* provided by opening itself, each of which retains a predetermined spacing in a peripheral direction at a bottom portion of the mixing chamber 55. The mixing chamber 55 has the bottom portion provided with a slant surface 53*b* inclined downwardly from each of the injection ports 53*a*. This slant surface 53*b* has a downward terminal end formed with an annular outlet 57 of the mixing chamber 55. The liquid fuel 6 injected from the plurality of fuel injection ports 53*a* mixes with the air 44 circulating in the mixing chamber 51 while flowing along the slant surfaces 53*b* to come to be the mixed air 56 which flows from the outlet 57 of the mixer chamber 55 toward the inlet 51*a* of the combustion chamber as shown in FIG. 4(B).

The catalyst is devised as follows.

As shown in FIG. 4(B), the substrates 4*a* of the catalyst 4 form the mixed air passage of cubic-mesh shape.

Ceramic is used for the substrates 4*a* an internal structure of which forms the mixed air passage of cubic-mesh shape.

Figure 4C:
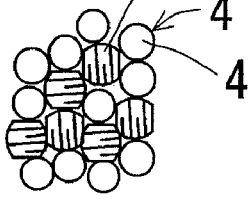

As shown in FIG. 4(C), a pellet-like substrate, for example a pellet-like ceramic may be used for the substrate 4*a*. A gap between adjacent substrates 4*a*, 4*a* may define the mixed air passage of cubic-mesh shape. In this case, advantageously, the substrates 4*a* are mixed with metal springs 66 and the resulting mixture is housed in the catalyst chamber 51 to make the metal springs 66 serve as cushions for the substrates 4*a*. Alumina pellet is employed for the substrate 4*a*. As for the metal spring 66, a barrel type is advantageous. This is because it is easily mixed with the alumina pellet owing to the similarity of shape with the alumina pellet. The metal spring 66 is formed from tungsten as a raw material. The metal spring 66 made of tungsten is subjected to gold-plating for anti-oxidation purpose.

The supply of the liquid fuel and air is devised as follows.

As shown in FIG. 1, fuel from a fuel reservoir 5*a* of the diesel engine is used for the liquid fuel 6. When the liquid fuel 6 is mixed with air 44, utilized for this air 44 is the air 44 from a supercharger 39.

As shown in FIG. 1, a liquid-fuel supply passage 46 is provided with a liquid-fuel valve 40 and an air supply passage 38 is formed with an air valve 41. Each of the valves 40 and 41 is associated via a controller 42 with a back-pressure sensor 43. In the event that the filter 2 is clogged with exhaust-gas fine particles, the back pressure increases. Based on the fact that the back-pressure sensor 43 detects this clogging, the controller 42 opens the liquid-fuel valve 40 and the air valve 41, thereby supplying the liquid fuel 6 and the air 44 to the gas generator 3 so as to vaporize the liquid fuel 6 in the catalyst chamber 51. Thus the liquid fuel 6 is converted to the flammable gas 7 which is fed into the exhaust route 1.

When commencing the generation of the flammable gas 7, the controller 42 energizes the electric heater 65 and after the elapse of a predetermined period of time, a timer stops energizing the electric heater 65.

In this embodiment, the liquid fuel 6 is vaporized in the catalyst chamber 51, thereby converting the liquid fuel 6 to the flammable gas 7.

The catalyst 4 in the catalyst chamber 51 is an oxidation catalyst that partly oxidizes the liquid fuel 6 and the resulting oxidation heat vaporizes the residual liquid fuel 6. The mixing ratio of the air 44 to the liquid fuel 6, namely air/fuel ratio O/C, is set to a range of 0.4 to 0.8 which is around 0.6. The catalyst component is platinum series.

Instead of vaporizing the liquid fuel 6, the liquid fuel 6 may be reformed. More specifically, the liquid fuel 6 may be partially oxidized in the catalyst chamber 51, thereby reforming the liquid fuel 6 to flammable gas 7 containing carbon monoxide and hydrogen.

In this case, as for the catalyst 4 in the catalyst chamber 51, a partial-oxidation catalyst is used instead of the oxidation catalyst. The mixing ratio of the air 44 to the liquid fuel 6, namely air/fuel ratio O/C is set to a range of 1.0 to 1.6 which is around 1.3.

The catalyst component is palladium series, rhodium series or the like.

A concrete construction of the filter-housing case is as follows.

As shown in FIG. 1, a cylindrical filter-housing case 11 provided at its opposite ends with end walls 17 and 18 is used. Where an axial direction of this filter-housing case 11 is a front and rear direction, one side on which an inlet 2*a* of the filter 2 is situated is the front and the other side on which an outlet 2*b* thereof is present is the rear. In the filter-housing case 11, an exhaust-gas inlet chamber 19 is arranged in front of the filter 2 and an exhaust-gas outlet chamber 20 is disposed at the rear of the filter 2, respectively. An exhaust-gas inlet pipe 21 and an exhaust-gas outlet pipe 22 are communicated with the exhaust-gas inlet chamber 19 and the exhaust-gas outlet chamber 20, respectively.

The exhaust-gas inlet pipe 21 is inserted into the exhaust-gas inlet chamber 19 along a radial direction of the filter-housing case 11. Provided between this exhaust-gas inlet pipe 21 and the exhaust-gas outlet 36 of the exhaust manifold is an exhaust-gas pipe 1*b*. The catalyst chamber 51 is arranged along an outer periphery of the exhaust-gas pipe 1*b*.

As shown in FIG. 1, an exhaust muffler 28 is employed for the filter-housing case 11. The exhaust-gas inlet chamber 19 is constructed by a first expansion chamber 29 and the exhaust-gas outlet chamber 20 is formed from a final expansion chamber 30. The exhaust-gas inlet pipe 21 is constructed by an exhaust lead-in pipe 31 of the first expansion chamber 29 and the exhaust-gas outlet pipe 22 is formed from an exhaust lead-out pipe 32 of the final expansion chamber 30.

The generation and function of the flammable gas are as follows.

As shown in FIG. 1, the liquid fuel 6 and the air 44 are supplied to the gas generator 3. As shown in FIG. 4(B), the liquid fuel 6 mixes with the air 44 to result in the mixed air 56 which is flowed into the catalyst chamber 51. Part of the liquid fuel 6 is oxidized (burnt by catalyst) within the catalyst chamber 51 to generate oxidation (combustion) heat. This oxidation (combustion) heat vaporizes the remaining liquid fuel 6 to produce flammable gas 7 of a high temperature. This high-temperature flammable gas 7, as shown in FIG. 2, is fed from the flammable-gas flow outlet 9 into the flammable-gas mixing passage 15. In the meantime, the part 10*a* of the exhaust gas 10 which passes through the exhaust route 1 flows into the flammable-gas mixing passage 15 to be mixed with the high-temperature flammable gas 7. On one hand, if part 10*a* of the exhaust gas 10 has a higher temperature, the flammable gas 7 is ignited by its heat, and on the other hand, if the part 10*a* of the exhaust gas 10 has a lower temperature, it is ignited by the heat resulting from exothermic reaction of the igniting electric heater 4. The flammable gas 7 is oxidized (burnt) by the oxygen in the part 10*a* of the exhaust gas 10 mixed as above to generate oxidation (combustion) heat which heats the part 10*a* of the exhaust gas 10 mixed. Further, the remaining part 10*b* of the exhaust gas 10 passes through the exhaust-gas passage 16 and is mixed with the heated part 10*a* of the exhaust gas 10 to be heated. The flammable gas 7 that has not be burnt by the ignition of the igniting electric heater 45*a* is burnt by being oxidized when passing through the oxidation catalyst 12 to increase the temperature of the exhaust gas 10.

As shown in FIG. 1, the exhaust gas 10 flows from the oxidation catalyst 12 as indicated by an arrow 60 and besides from an outlet hole 47 of the exhaust lead-in pipe 31 and then flows into the first expansion chamber 29. Thereafter, the exhaust gas 10 flows into the filter 2 through its inlet 2*a* and passes through an interior area of the filter 2. The exhaust gas 10 that has passed through the interior area of the filter 2 flows into the final expansion chamber 30 through the outlet 2*b* of the filter 2 as indicated by arrows 63 and then flows into the exhaust lead-out pipe 32 from the inlet hole 48 thereof. Thereafter, it is flowed out of the exhaust lead-out pipe 32 as indicated by an arrow 64.

A second embodiment is different from the first embodiment on the following points.

As shown in FIG. 5, a heat radiation wall 8 is utilized for the ignition means 45.

More specifically, the exhaust-passage peripheral wall 1*a* with the catalyst chamber 51 arranged along the same serves as the heat radiation wall 8. The flammable gas 7 heated within the catalyst chamber 51 is mixed with the exhaust gas 10 in the exhaust route 1, and the heat radiation wall 8 radiates the catalyst-combustion heat produced within the catalyst chamber 51 to the mixed gas, thereby enabling the heat radiation wall 8 to serve as the ignition means 45 so as to be able to ignite the flammable gas 7.

This construction can assuredly burn the flammable gas in the exhaust route 1.

The catalyst chamber 51 is arranged along the entire area in the peripheral direction of the peripheral wall 1*a* of the exhaust route 1 and the heat radiation wall 8 is formed over the whole region in the peripheral direction of the peripheral wall 1*a* of the exhaust route 1.

A partition wall 14 is provided in the exhaust-route peripheral wall 1*a* with the catalyst chamber 51 arranged along the same and divides the interior area of the exhaust route 1 into the flammable-gas mixing passage 15 and the exhaust-gas passage 16. The flammable-gas mixing passage 15 has an inlet 15*a* with which the flammable-gas flow outlet 9 is communicated and has the heat radiation wall 8 arranged in its interior area. The heat radiation wall 8 can ignite the flammable gas 7 while the flammable gas 7 heated in the catalyst chamber 51 is being mixed with part 10*a* of the exhaust gas 10 in the flammable-gas mixing passage 15.

The other construction and function are the same as those of the first embodiment. In FIG. 5, the same elements as those in the first embodiment are designated by the same numerals.

The invention claimed is:

1. An exhaust device for a diesel engine which supplies liquid fuel (6) from a liquid-fuel supply source (5) to a gas generator (3) which converts the liquid fuel (6) to flammable gas (7), a flammable-gas flow outlet (9) of the gas generator (3) being communicated with an exhaust route (1) upstream of a diesel-particulate-filter (2), the flammable gas (7) flowed out from the flammable-gas flow outlet (9) being burnt with oxygen in exhaust gas (10) to generate combustion heat, the exhaust gas (10) heated by the combustion heat being able to burn exhaust-gas fine particles remaining at the filter (2), wherein the gas generator (3) is provided with a catalyst chamber (51) which houses a catalyst (4) and within which catalyst-combustion heat is produced, the catalyst chamber (51) being arranged along an external periphery of a peripheral wall (1*a*) of the exhaust route (1), wherein a partition wall (14) provided within the peripheral wall (1*a*) of the exhaust route (1) divides an interior area of the exhaust route (1) into a flammable-gas mixing passage (15) and an exhaust-gas passage (16), a starting end portion (15*a*) of the flammable-gas mixing passage (15) being communicated with the flammable-gas flow outlet (9), an ignition means (45) comprising an igniting electric heater (45*a*) arranged at a predetermined portion in a region extending from an interior area of the flammable-gas mixing passage (15) to just after its terminal end portion (15*b*), the flammable gas (7) heated within the catalyst chamber (51) being mixed with part (10*a*) of the exhaust gas (10) in the flammable-gas mixing passage (15), and the ignition means (45) igniting the flammable gas (7).

2. The exhaust device for a diesel engine as set forth in claim 1, wherein the catalyst chamber (51) is arranged over an entire area in a peripheral direction of the peripheral wall (1*a*) of the exhaust route (1).

3. The exhaust device for a diesel engine as set forth in claim 1, wherein an outlet-side flange (1*c*) is provided at an end portion downstream of the exhaust-route peripheral wall (1*a*) and an inlet-side flange (11*c*) is provided at a case (11) which houses the filter (2), and when connecting the outlet-side flange (1*c*) of the exhaust-route peripheral wall (1*a*) to the inlet-side flange (11*c*) of the filter-housing case (11), a cylindrical wall (1*d*) is provided inside the exhaust route (1) and a heat-insulation space (1*e*) is defined between the cylindrical wall (1*d*) and the peripheral wall (1*a*) of the exhaust route (1) as well as between the cylindrical wall (1*d*) and the outlet-side flange (1*c*).

4. The exhaust device for a diesel engine as set forth in claim 1, wherein an oxidation catalyst (12) is arranged downstream of the ignition means (45) and upstream of the filter (2).

5. The exhaust device for a diesel engine as set forth in claim 1, wherein fuel from a fuel reservoir (5*a*) of the diesel engine is employed for the liquid fuel (6), and when mixing air (44) into the liquid fuel (6), air (44) from a supercharger (39) is used for the air (44).

6. The exhaust device for a diesel engine as set forth in claim 1, wherein the liquid fuel (6) is vaporized in the catalyst chamber (51), thereby converting the liquid fuel (6) to the flammable gas (7).

7. The exhaust device for a diesel engine as set forth in claim 1, wherein the liquid fuel (6) is partially oxidized in the catalyst chamber (51), thereby reforming the liquid fuel (6) to flammable gas (7) containing carbon monoxide and hydrogen.

8. The exhaust device for a diesel engine as set forth in claim 1, wherein the flammable-gas mixing passage (15) has a sectional area varying along a flow direction.

9. The exhaust device for a diesel engine as set forth in claim 8, wherein the flammable-gas mixing passage (15) has the sectional area increasing gradually toward the downstream.

10. The exhaust device for a diesel engine as set forth in claim 1, wherein a substrate (4*a*) of the catalyst (4) forms a mixed air passage of cubic-mesh shape.

11. The exhaust device for a diesel engine as set forth in claim 10, wherein a pellet-like substrate is used for the substrate (4*a*) and a gap between adjacent substrates (4*a*) and (4*a*) defines the mixed air passage of cubic-mesh shape.

12. The exhaust device for a diesel engine as set forth in claim 1, wherein a mixer (52) is disposed on a side of an inlet (51*a*) of the catalyst chamber (51) and the liquid fuel (6) supplied from a fuel nozzle (53) is mixed with air (44) in a mixing chamber (55), and when supplying mixed air (56) from the outlet (57) of the mixing chamber (55) to the inlet (51*a*) of the catalyst chamber (51), the catalyst-combustion heat produced in the catalyst chamber (51) is conveyed to the fuel nozzle (53) by a heat conductor (58).

13. The exhaust device for a diesel engine as set forth in claim 12, wherein the heat conductor (58) has an exposed surface (58*a*) arranged in a position opposite to the inlet (51*a*) of the catalyst chamber (51) and the liquid fuel (6) that has flowed out from the outlet (57) of the mixing chamber (55) is brought into contact with the exposed surface (58*a*) of the heat conductor (58).

14. The exhaust device for a diesel engine as set forth in claim 13, wherein an electric heater (65) is brought into contact with the heat conductor (58) so as to heat the heat conductor (58) when commencing the generation of the flammable gas.

15. An exhaust device for a diesel engine which supplies liquid fuel (6) from a liquid-fuel supply source (5) to a gas generator (3) which converts the liquid fuel (6) to flammable gas (7), a flammable-gas flow outlet (9) of the gas generator (3) being communicated with an exhaust route (1) upstream of a diesel-particulate-filter (2), the flammable gas (7) flowed out from the flammable-gas flow outlet (9) being burnt with oxygen in exhaust gas (10) to generate combustion heat, the exhaust gas (10) heated by the combustion heat being able to burn exhaust-gas fine particles remaining at the filter (2), the gas generator (3) provided with a catalyst chamber (51) which houses a catalyst (4) and within which catalyst-combustion heat is produced, the catalyst chamber (51) being arranged along an external periphery of a peripheral wall (1*a*) of the exhaust route (1), wherein a partition wall (14) provided within the peripheral wall (1*a*) of the exhaust route (1) divides an interior area of the exhaust route (1) into a flammable-gas mixing passage (15) and an exhaust-gas passage (16), a starting end portion (15*a*) of the flammable-gas mixing passage (15) being communicated with the flammable-gas flow outlet (9), an ignition means (45) arranged at a predetermined portion in a region extending from an interior area of the flammable-gas mixing passage (15) to just after its terminal end portion (15*b*), and the flammable gas (7) heated within the catalyst chamber (51) being mixed with part (10*a*) of the exhaust gas (10) in the flammable-gas mixing passage (15), and the ignition means (45) ignites the flammable gas (7), wherein an outlet-side flange (1*c*) provided at an end portion downstream of the exhaust-route peripheral wall (1*a*) and an inlet-side flange (11*c*) provided at a case (11) which houses the filter (2), and when connecting the outlet-side flange (1*c*) of the exhaust-route peripheral wall (1*a*) to the inlet-side flange (11*c*) of the filter-housing case (11), a cylindrical wall (1*d*) provided inside the exhaust route (1) and a heat-insulation space (1*e*) defined between the cylindrical wall (1*d*) and the peripheral wall (1*a*) of the exhaust route (1) as well as between the cylindrical wall (1*d*) and the outlet-side flange (l*c*).

16. The exhaust device for a diesel engine as set forth in claim 15, wherein the ignition means (45) is an igniting electric heater (45*a*).

17. The exhaust device for a diesel engine as set forth in claim 15, wherein the exhaust-route peripheral wall (1*a*) with the catalyst chamber (51) arranged along the same serves as a heat radiation wall (8), which is used for the ignition means (45).

18. An exhaust device for a diesel engine which supplies liquid fuel (6) from a liquid-fuel supply source (5) to a gas generator (3) which converts the liquid fuel (6) to flammable gas (7), a flammable-gas flow outlet (9) of the gas generator (3) being communicated with an exhaust route (1) upstream of a diesel-particulate-filter (2), the flammable gas (7) flowed out from the flammable-gas flow outlet (9) being burnt with oxygen in exhaust gas (10) to generate combustion heat, the exhaust gas (10) heated by the combustion heat being able to burn exhaust-gas fine particles remaining at the filter (2), the gas generator (3) provided with a catalyst chamber (51) which houses a catalyst (4) and within which catalyst-combustion heat is produced, the catalyst chamber (51) being arranged along an external periphery of a peripheral wall (1*a*) of the exhaust route (1), and a substrate (4*a*) of the catalyst (4) forming a mixed air passage of cubic-mesh shape, wherein when pellet-like ceramic is used for the substrate (4*a*) and a gap between adjacent substrates (4*a*) and (4*a*) defines the mixed air passage of cubic-mesh shape, the substrates (4*a*), (4*a*) are mixed with metal springs (66) and the thus formed mixture is housed in the catalyst chamber (51), the metal springs (66) serving as a cushion for the substrate (4*a*).

* * * * *